US008483015B2

(12) United States Patent
Mahler et al.

(10) Patent No.: US 8,483,015 B2
(45) Date of Patent: Jul. 9, 2013

(54) AM/PM DISPLAY DEVICE FOR A TIMEPIECE

(75) Inventors: Olivier Mahler, Fontaines (CH); Raphael Loeffel, Le Landeron (CH)

(73) Assignee: Compagnie des Montres Longines, Francillon S.A., Saint-Imier (CH)

( * ) Notice: Subject to any disclaimer, the term of this patent is extended or adjusted under 35 U.S.C. 154(b) by 121 days.

(21) Appl. No.: 13/160,933

(22) Filed: Jun. 15, 2011

(65) Prior Publication Data

US 2011/0310707 A1 Dec. 22, 2011

(30) Foreign Application Priority Data

Jun. 17, 2010 (EP) ..... 10166358

(51) Int. Cl.
*G04B 19/26* (2006.01)

(52) U.S. Cl.
USPC ..... 368/17; 368/223

(58) Field of Classification Search
USPC ..... 368/15–20, 223
See application file for complete search history.

(56) References Cited

U.S. PATENT DOCUMENTS

| | | | | |
|---|---|---|---|---|
| 508,467 | A * | 11/1893 | Clark | 368/18 |
| 3,595,009 | A * | 7/1971 | Pakter et al. | 368/80 |
| 4,684,260 | A | 8/1987 | Jackle | |
| 4,759,002 | A * | 7/1988 | Cash | 368/15 |
| 5,023,849 | A * | 6/1991 | Vaucher | 368/15 |
| 5,898,645 | A * | 4/1999 | Sugiyama | 368/82 |
| 5,917,778 | A * | 6/1999 | James et al. | 368/17 |
| 6,359,839 | B1 | 3/2002 | Schenk et al. | |
| 6,507,536 | B1 * | 1/2003 | Keatch | 368/16 |
| 7,649,811 | B2 * | 1/2010 | Courvoisier et al. | 368/18 |
| 2004/0223413 | A1 * | 11/2004 | Rey-Mermet | 368/18 |

FOREIGN PATENT DOCUMENTS

| | | |
|---|---|---|
| CH | 671 317 | 8/1989 |
| FR | 2 334 135 | 7/1977 |
| WO | WO 2008/125535 A2 | 10/2008 |

OTHER PUBLICATIONS

European Search Report issued Nov. 24, 2010, in Europe Application No. 10166358.1, filed Jun. 17, 2010 (with English Translation of Category of Cited Documents).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention concerns an AM/PM display disc (1), rotating in one day about an axis of rotation (2), including two different juxtaposed surfaces (3, 4).

It is characterized in that the surfaces are delimited, between a hub (5) and the periphery (6) of said disc (1) by two boundary curves (7, 8), each tangential to said periphery (6) and having a single concavity from said periphery (6) towards said hub (5), the concavities of said curves (7, 8) having the same direction relative to the direction of rotation (A) of said disc (1), and any radial line originating from said axis (2) intersecting, in succession, one of said two surfaces, then the other, and only passing through one of said curves between said hub (5) and said periphery (6).

The invention also concerns an AM/PM display device (100) including an aperture (20) and a disc of this type (1), characterized in that said axis (2) is external to said aperture (20) which is symmetrical relative to an axis of symmetry (22) passing through said axis of rotation (2).

The invention also concerns a timepiece incorporating a device (100) of this type.

12 Claims, 3 Drawing Sheets

AM/PM DISPLAY DEVICE FOR A TIMEPIECE

This application claims priority from European Patent Application No. 10166358.1 filed Jun. 17, 2010, the entire disclosure of which is incorporated herein by reference.

FIELD OF THE INVENTION

The invention concerns an AM/PM display disc for a timepiece, rotating in twenty-four hours about an axis of rotation.

The invention concerns an AM/PM display device for a timepiece, including a twenty-four hour rotating disc of this type and an aperture in a dial arranged to be integrated in a timepiece.

The invention also concerns a timepiece incorporating a device of this type.

The invention concerns the field of timepieces, and more particularly those which include a visual, twelve hour time display, which are the most common.

BACKGROUND OF THE INVENTION

The user may, in some circumstances, and particularly during a long journey, lose his bearings and have difficulty telling whether his timepiece is displaying the daytime or night-time, or even the morning or afternoon, hereinafter respectively designated "AM" and "PM". Hereinafter a visual display showing the time of day in relation to the midday hour will be called an "AM/PM" display.

Numerous devices are known for solving the first problem of the day-night display, generally based on a disc, connected to a twenty-four hour wheel of the timepiece, a coloured part of which is visible through an aperture, with distinct colours for the day and night. CH Patent Application No 671 317 A3 in the name of GASTON GAGNEBIN is also known, disclosing a timepiece wherein daytime and night-time are represented by images of the sun and a star carried by an indicator disc and appearing alternately in an aperture. U.S. Pat. No. 6,359,839 B1 in the name of SCHENK THOMAS is also known, with a specific display for the same purpose showing transitory periods.

The problem still remains unresolved for the transitory phases of dawn and dusk, for which the user has no information enabling him to differentiate between them, to know where he is in relation to midday.

SUMMARY OF THE INVENTION

The present invention therefore proposes to provide a solution to the problem of displaying the instantaneous relative position in relation to the midday hour.

The invention therefore concerns an AM/PM display disc rotating in twenty-four hours about an axis of rotation and including a graphic display comprising a first surface and a second surface, which are juxtaposed, joined and of similar shape, wherein said first surface includes a first decoration that corresponds to daytime, and said second surface has a second decoration that corresponds to night-time and is different from said first decoration, characterized in that said first surface and said second surface are delimited, between a hub centred on said axis of rotation and the periphery of said disc, by a first boundary curve and a second boundary curve each substantially tangential to said periphery and each having a single concavity from said periphery towards said hub, the concavities of said first boundary curve and said second boundary curve having the same direction relative to the direction of rotation of said disc, and any radial line originating from said axis of rotation intersecting, in succession, first one of said first and second surfaces, then the other, and only passing through one of said boundary curves between said hub and said periphery.

According to a feature of the invention, said first boundary curve and said second boundary curve are identical to each other.

According to a feature of the invention, said first boundary curve and said second boundary curve are semi-circles tangential both to said periphery and to said hub, and the point of tangency with said hub is on the side of the hub opposite to that facing its peripheral point of tangency.

According to a feature of the invention, said disc has radial graduations defining in pairs a time segment of defined amplitude, on either side of the representation of midday on said disc, at least over the whole of said first surface.

According to a feature of the invention, said time segments are hourly or bi-hourly.

According to a feature of the invention, said disc includes concentric graduations to show improved visibility of the daytime part and night-time part.

According to a feature of the invention, said disc includes a symbol positioned at the midday hour on the disc.

The invention further concerns an AM/PM display device for a timepiece, including this type of AM/PM disc and an aperture in a dial arranged to be integrated in a timepiece, said disc being partially visible through said aperture, characterized in that said aperture is external or tangential to said aperture, and in that said aperture is lenticular in shape and substantially symmetrical relative to an axis of symmetry passing through said axis of rotation.

According to a feature of the invention, said axis of symmetry is arranged parallel to the six o'clock-midday axis of said timepiece.

According to a feature of the invention, the amplitude of said aperture in a perpendicular direction to said axis of symmetry defines an amplitude of time limited to a few hours so that the period of day, relative to the midday hour, is displayed at more or less two hours around the present moment.

The invention also concerns a timepiece including a movement arranged to drive a twenty-four hour wheel comprised in said device, characterized in that it includes a dial or support surface for said aperture. The axis of symmetry of the aperture is arranged parallel to the six o'clock-midday axis of said timepiece.

Thus, the AM/PM display is achieved using a single disc.

During the daytime segment, a progressive end of night-time indicator close to the hub of the disc, and a progressive start of night-time indicator at the periphery of the disc immediately enable the user to determine proximity to dawn and dusk respectively. This progressive indication is symmetrical.

BRIEF DESCRIPTION OF THE DRAWINGS

Other features and advantages of the invention will appear upon reading the following description, with reference to the annexed Figures, in which:

FIGS. 6 to 13 show schematically plan views of an AM/PM display device according to the invention, including an aperture behind which the disc of FIG. 1 moves in rotation, in a sequence in which FIG. 6 illustrates night-time, FIG. 7 dawn, FIG. 8 the start of the morning, FIG. 9 the end of the morning and approach of midday, FIG. 10 the start of the afternoon, FIG. 11 the end of the afternoon, FIG. 12 dusk, and FIG. 13 nightfall.

FIGS. 14 to 20 show schematically in plan views of an AM/PM display device according to the invention including another type of aperture behind which the disc of FIG. 1 moves in rotation, in a sequence in which FIG. 14 illustrates night-time, FIG. 15 dawn, FIG. 16 the start of the morning, FIG. 17 the end of the morning and approach of midday, FIG. 18 the start of the afternoon, FIG. 19 the end of the afternoon, and FIG. 20 dusk.

DETAILED DESCRIPTION OF PREFERRED EMBODIMENTS

Figure 1:
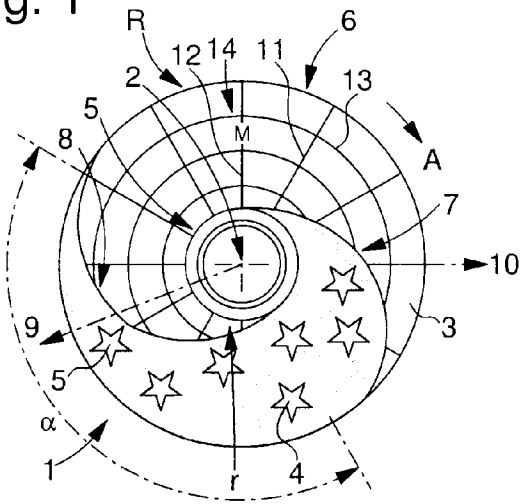
FIG. 1 shows schematically a plan view of an AM/PM display disc according to the invention, in a preferred embodiment.
Figure 2:
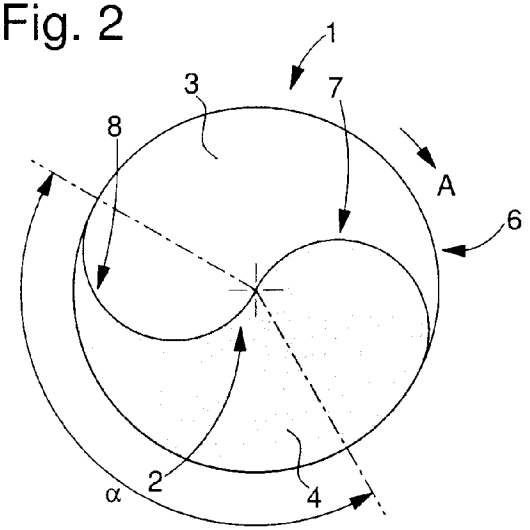
FIG. 2 shows, in a similar manner to FIG. 1, a display disc close to the invention.
Figure 3:
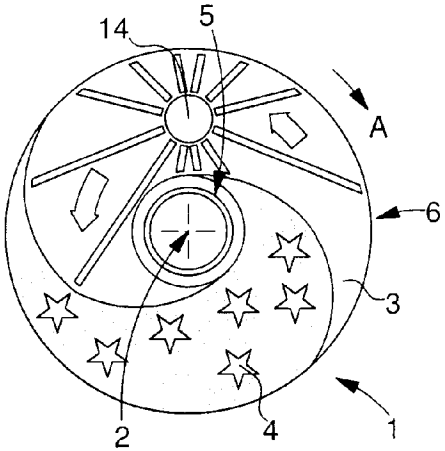
FIGS. 3 to 5 show in a similar manner to FIG. 1, other disc models according to the invention.
Figure 4:
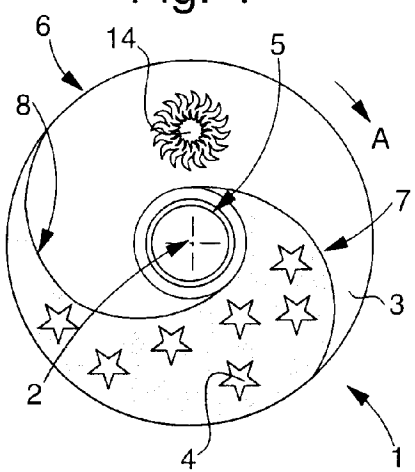
Figure 5:
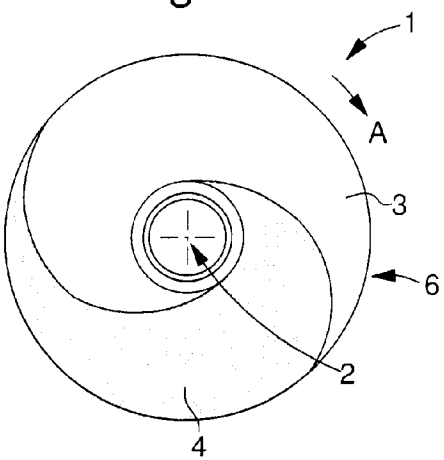
Figure 6:
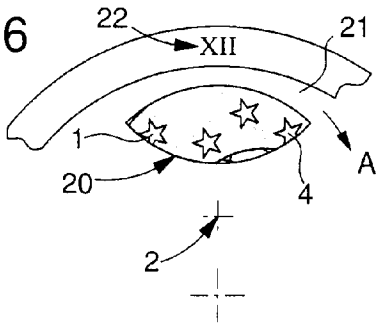
Figure 7:
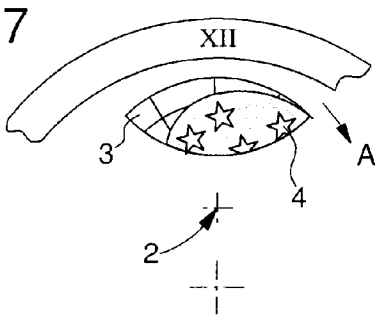
Figure 8:
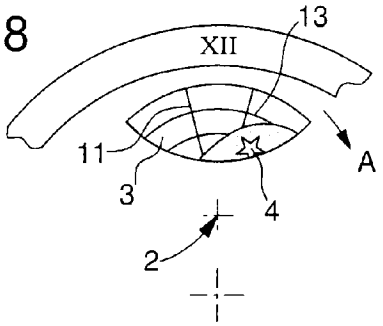
Figure 9:
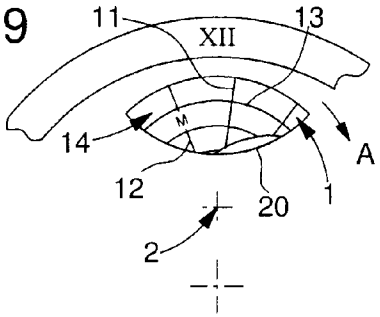
Figure 10:
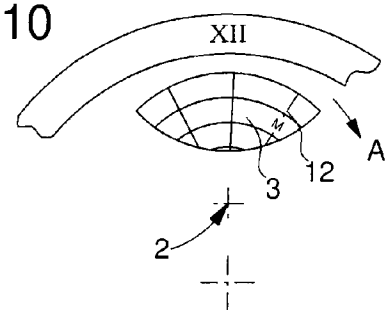
Figure 11:
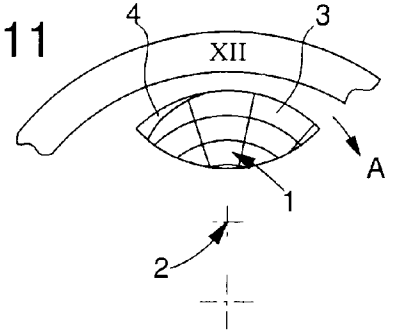
Figure 12:
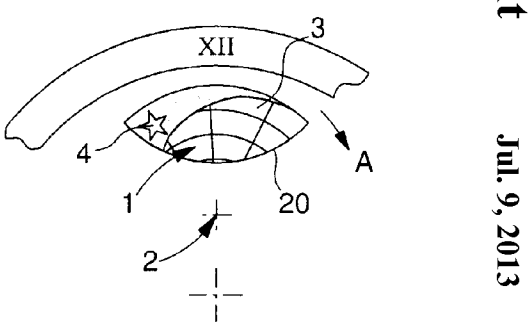
Figure 13:
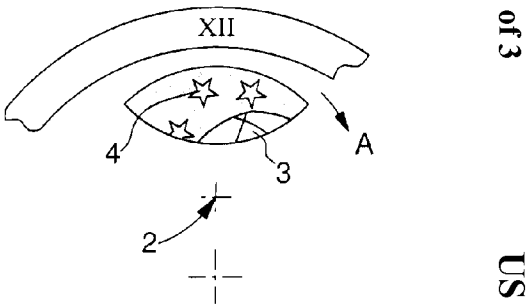
Figure 14:
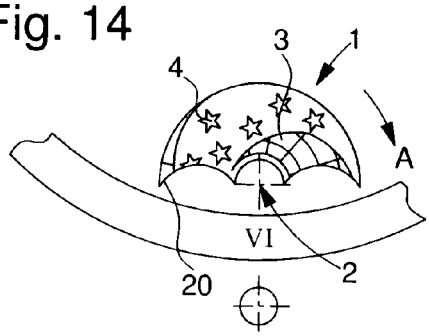
Figure 17:
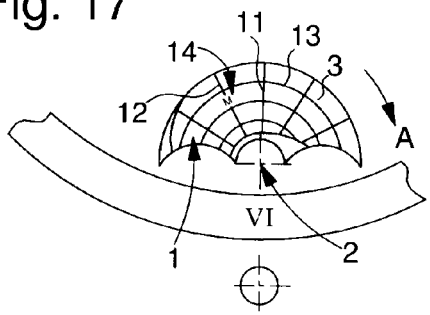
Figure 15:
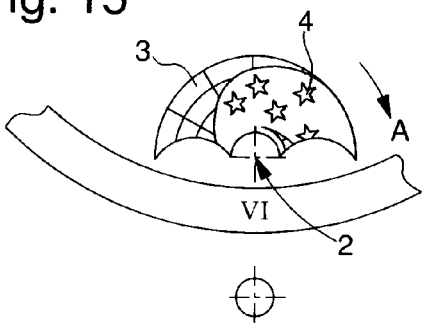
Figure 18:
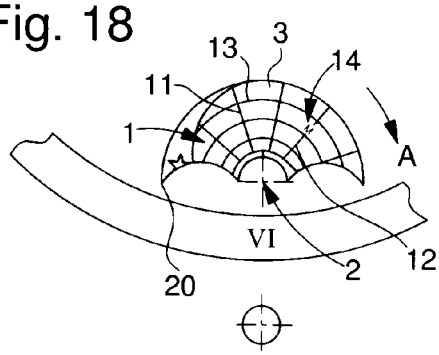
Figure 16:
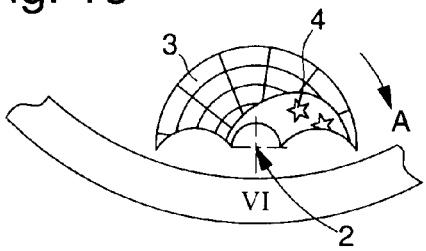
Figure 19:
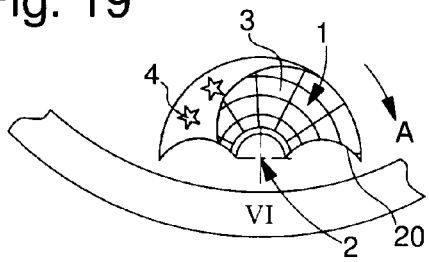
Figure 20:
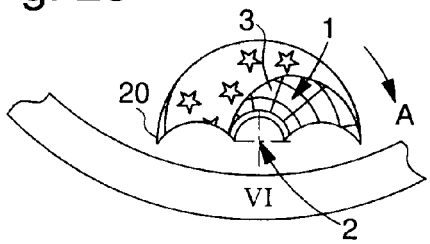

The invention concerns the field of timepieces, and more particularly those which include a visual, twelve hour time display, which are the most common. It concerns more specifically a display that allows the user to tell whether the present moment is in the morning or afternoon, and to estimate the difference relative to the midday hour.

A rotatable disc 1 continually rotates and completes one revolution in 24 hours, and includes a graphic display, allowing the user to estimate:

the daytime/night-time position;

The transitory phases of dawn and dusk;

the morning/afternoon position in the middle of the day.

The invention therefore concerns an AM/PM display disc 1 for a timepiece, rotating in twenty-four hours about an axis of rotation 2 in a direction of rotation A, which is preferably clockwise. This disc 1 has a graphic display including a first surface 3 and a second surface 4 which are juxtaposed, joined and of similar shape. Disc 1 is designed to be partially seen through an aperture 20 in a display device 100 arranged to be integrated in a timepiece.

The first surface 3 includes a first decoration corresponding to daytime, and the second surface 4 has a second decoration that corresponds to night-time and is different from the first decoration. These decorations are highly differentiated from each other, for example in coloured patches, one of which is evocative of night-time such as black, and the other daytime, such as blue or a light-coloured shade.

According to the invention, the first surface 3 and the second surface 4 are delimited, between a hub 5 of radius r centred on axis of rotation 2, and the periphery 6 of radius R of disc 1, by a first boundary curve 7, which symbolises the change from night-time to daytime, and a second boundary curve 8, which symbolises the change from daytime to night-time. These two boundary curves 7 and 8 are preferably each substantially tangential to periphery 6 and each has a single concavity from periphery 6 towards hub 5.

The concavities of first boundary curve 7 and second boundary curve 8 are in the same direction relative to the direction of rotation A of disc 1, as seen in FIGS. 1 to 5.

Any radial line originating from axis of rotation 2 intersects, in succession, first of all one of the two first 3 and second 4 surfaces, then the other, and only passes through one of boundary curves 7 and 8 between hub 5 and periphery 6. Thus, as seen in FIG. 1, a radial line 9 originating from axis 2 passes first of all through first surface 3 corresponding to daytime, then second boundary curve 8, then second surface 4, before rejoining periphery 6. Whereas a radial line 10 originating from axis 2 first of all passes through second surface 4 representing night-time, then the first boundary curve 7, then first surface 3, before rejoining periphery 6.

A radial line originating from axis 2 parallel to the six o'clock-midday axis of the timepiece displays the part of daytime and part of night-time at the moment concerned.

In short, each of the boundary curves corresponds to an increase in radius according to the central angle of the disc, from the point of contact thereof with hub 5 up to the point of contact thereof with periphery 6, without any turn back point.

Border curves 7 and 8 have a spiral course and can fit various geometrical definitions. A simple way of making the outline, in a particular embodiment shown in the Figures, is to make the curves in the form of semi-circles tangential to periphery 6 and secant or tangential to hub 5. In this latter case, the point of tangency with hub 5 is on the side thereof opposite the side facing its peripheral point of tangency. The radius of these semi-circles is comprised between the minimum value R/2 for preventing any turn back, and the maximum value (R+r)/2 which corresponds to a preferred embodiment of a boundary curve tangential to hub 5 on the side opposite the side of its point of tangency with periphery 6. This maximum boundary curve thus meets the requirement that a given radial line only intersects a single boundary curve between the hub and the periphery. Naturally, other profiles can be envisaged without departing from the invention.

In a preferred embodiment, as seen in the Figures, the first boundary curve 7 and the second boundary curve 8 are identical and shifted at a certain central angle $\alpha$. Of course, this angle $\alpha$, which illustrates the relative part of daytime or night-time during a 24 hour day, depends both upon the latitude of the place and the time of year. Evidently, it is possible to envisage multiplying the discs, with, for example, a different disc for each season, and driving a cover, comprising an aperture 20 and a 3 month sequence, to conceal three of the discs at any time and reveal the fourth, said discs all being able to be driven permanently by the same 24 hour wheel of the timepiece movement. Since the space available does not generally allow this multiplication of discs, the representation may be merely a rough representation, as seen in the Figures, where the first daytime surface 3 is larger than the second night-time surface 4, and where angle $\alpha$ is thus less than 180°.

The AM/PM display proposed by the invention is deliberately a display allowing the user quickly to identify what time of day it is, when he is in a situation in which he loses his normal bearings and sense of time, for example during a stay of several days in artificial light or during the Arctic night or when travelling, etc. The timepiece display still displays the precise time and what the user needs to know instantaneously, via a graphic display, is whether it is morning or evening time or even night-time.

In a variant, disc 1 may be used without a hub. The value of radius r is then zero and boundary curves 7 and 8 pass through axis 2. Preferably, they are semi-circles of radius R/2.

The disc may also include, as in the example of FIG. 1, radial graduations 11 defining in pairs a time segment of defined amplitude, on either side of the midday representation on the disc, notably by a particular graduation 12, for example a line with a particular superimposed mark as seen in FIG. 1, at least over the whole of first surface 3. These time segments may be hourly or bi-hourly, which is easier to read on a disc of small diameter. The user may thus estimate the time segment separating the present time from the midday hour. This FIG. 1 shows that curves 7 and 8 extend between two concentric circles 5 and 6, which, in this particular case, correspond to and delimit the segment covered by the graduations.

Disc 1 may also include concentric graduations 13 to show improved visibility of the daytime part and night-time part.

Preferably, for quick visualisation, disc 1 includes a symbol 14 positioned at the midday hour on the disc.

The invention further concerns an AM/PM disc 100 for a timepiece, including an AM/PM display disc 1 of this type and an aperture 20 in a dial 21 arranged to be integrated in a timepiece. Disc 1 is partially visible through aperture 20. According to the invention, the axis of rotation 2 of disc 1 is external or tangential to aperture 20 and aperture 20 is lenticular in shape and substantially symmetrical relative to an axis of symmetry 22, which passes through axis of rotation 2.

This axis of symmetry is preferably arranged parallel to the six o'clock-midday axis of the timepiece in which device 100 is incorporated.

Preferably, the surface of aperture 20 the furthest from axis of rotation 2 of disc 1 is circular and corresponds to the periphery 6 of said disc.

Preferably, hub 5 of disc 1 is not visible and is concealed by the aperture.

When the disc is rotating in the clockwise direction of rotation A, and aperture 20 is located above axis of rotation 2 of disc 1, the part of disc 1 visible to the right inside aperture 20 illustrates the past, whereas the part of disc 1 visible to the left inside aperture 20 illustrates the future.

The amplitude of aperture 20, in a perpendicular direction to axis of symmetry 22 defines an amplitude of time limited to a few hours, for example 4 to 5 hours, so as to display the time of day, relative to the midday hour, at more or less two hours around the present moment.

From axis 2 towards periphery 6, the user always sees, during daytime, on the right of aperture 20, a part of the second night-time decoration surface 4 close to axis 2 in the morning. This part of decoration disappears around midday, and a part of the night-time decoration reappears in the afternoon, but this time at periphery 6 and no longer close to axis 2 (night "fall").

From axis 2 towards periphery 6, the user always sees during night-time, on the right of aperture 20, a part of the first daytime decoration surface 3 close to axis 2 at the start of the evening, after dusk. This part of the daytime decoration disappears around midnight and a part of the daytime decoration reappears at the end of the night, but this time at the periphery 6 and no longer close to axis 2.

The invention also concerns a timepiece including a movement arranged for driving a twenty-four hour wheel comprised in said device 100. This timepiece includes a dial 21 or support surface for aperture 20, the axis of symmetry of said aperture being arranged parallel to the six o'clock-midday axis of said timepiece.

In short, the AM/PM display is achieved with a single disc 1,

During the daytime segment, a progressive end of night-time indicator close to hub 5 of disc 1, as seen in FIGS. 7, 8, 15 and 16, and a progressive start of night-time indicator at the periphery 6 of the same disc 1, as seen in FIGS. 11, 12, 18 and 19, immediately enable the user to determine the respective proximity of dawn and dusk. This progressive indication is symmetrical.

In a variant, the display device 100 includes a device for adjusting the disc in an angular position, so as to display real solar time and the time lag with standard time.

In another variant, it includes a device for orientating the disc via a time equation cam.

What is claimed is:

1. A timepiece including an AM/PM display disc, rotating in twenty-four hours about an axis of rotation and including a graphic display comprising a first surface and a second surface, which are juxtaposed, joined and of similar shape, wherein said timepiece includes a movement arranged to drive a twenty-four hour wheel, and wherein said first surface includes a first decoration that corresponds to daytime, and said second surface has a second decoration that corresponds to night-time and is different from said first decoration, wherein said first surface and said second surface are delimited, between a hub centred on said axis of rotation and the periphery of said disc, by a first boundary curve and a second boundary curve each substantially tangential to said periphery and each having a single concavity from said periphery towards said hub, the concavities of said first boundary curve and said second boundary curve having the same direction relative to the direction of rotation of said disc, and any radial line originating from said axis of rotation intersecting, in succession, first one of said first and second surfaces, then the other, and only passing through one of said boundary curves between said hub and said periphery, and wherein said graphic display is rotating in twenty-four hours.

2. The timepiece according to claim 1, wherein said first boundary curve and said second boundary curve are identical.

3. The timepiece according to claim 1, wherein said first boundary curve and said second boundary curve are semicircles tangential both to said periphery and to said hub, and the point of tangency with said hub is on the side of the hub opposite to that facing the peripheral point of tangency thereof.

4. The timepiece according to claim 1, wherein said AM/PM display disc includes radial graduations defining in pairs a time segment of defined amplitude, on either side of the representation of midday on said disc, at least over the whole of said first surface.

5. The timepiece according to claim 4, wherein said time segments are hourly or bi-hourly.

6. The timepiece according to claim 1, wherein said AM/PM display disc includes concentric graduations to show improved visibility of the daytime part and night-time part.

7. The timepiece according to claim 1, wherein said AM/PM display disc includes a symbol positioned at the midday hour on the disc.

8. The timepiece according to claim 1, and an aperture in a dial arranged to be integrated in a timepiece, said disc being partially visible through said aperture, wherein said axis of rotation is external or tangential to said aperture, and wherein said aperture is lenticular in shape and substantially symmetrical relative to an axis of symmetry passing through said axis of rotation, wherein said AM/PM display device includes a dial or a support surface for said aperture, and said axis of symmetry of the aperture is arranged parallel to the six o'clock-midday axis of said timepiece.

9. The timepiece according to claim 8, wherein said axis of symmetry is arranged parallel to the six o'clock-midday axis of said timepiece.

10. The timepiece according to claim 9, wherein the amplitude of said aperture in a perpendicular direction to said axis of symmetry defines a time amplitude limited to a few hours such that the time of day is visualised, relative to the midday hour, at more or less two hours around the present instant.

11. The timepiece according to claim 1, wherein said AM/PM display device includes a device for adjusting the disc in an angular position, so as to display real solar time and the time lag with standard time.

12. The timepiece according to claim 1, wherein said AM/PM display device includes a device for orientating the disc via a time equation cam.

* * * * *